US006201200B1

(12) United States Patent
Pearson et al.

(10) Patent No.: US 6,201,200 B1
(45) Date of Patent: Mar. 13, 2001

(54) SELF LOCKING KNOB ATTACHMENT SHAFT FOR PROGRAM TIMERS

(75) Inventors: James E. Pearson, Downers Grove; Ronald S. Joyce, Elk Grove Village; Paul H. Tuma, Lombard, all of IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/271,576

(22) Filed: Mar. 18, 1999

Related U.S. Application Data

(60) Provisional application No. 60/113,829, filed on Dec. 23, 1998, now abandoned, and provisional application No. 60/121,094, filed on Feb. 22, 1999, now abandoned.

(51) Int. Cl.[7] ..... H01H 19/00

(52) U.S. Cl. ..... 200/336; 464/179; 464/185

(58) Field of Search ..... 200/33 R–40, 200/336; 464/179–183, 185

(56) References Cited

U.S. PATENT DOCUMENTS

| | | | |
|---|---|---|---|
| 3,626,133 | 12/1971 | Teruzzi | 200/168 R |
| 4,037,489 | 7/1977 | Morel | 74/548 |
| 4,149,046 | 4/1979 | Bolin | 200/38 A |
| 4,355,921 | 10/1982 | Rousseau | 403/316 |
| 4,412,110 | 10/1983 | Wojtanek | 200/38 R |
| 4,796,484 | 1/1989 | Eder | 74/568 T |
| 4,892,982 | 1/1990 | Hueber et al. | 200/38 R |
| 4,948,928 | 8/1990 | Willigman | 200/38 R |
| 5,032,698 | 7/1991 | Satoh | 200/341 |
| 5,059,754 | 10/1991 | Kaichi et al. | 200/332.1 |
| 5,220,542 | 6/1993 | Zink et al. | 368/107 |
| 5,601,491 | 2/1997 | Chan et al. | 464/37 |
| 5,652,418 | 7/1997 | Amonett | 200/38 B |
| 5,652,419 | 7/1997 | Amonett et al. | 200/38 R |
| 5,684,281 | 11/1997 | Amonett | 200/38 R |
| 5,689,096 | 11/1997 | Weaver et al. | 200/38 R |
| 5,739,490 | 4/1998 | Amonett et al. | 200/38 B |
| 5,750,948 | 5/1998 | Amonett et al. | 200/38 R |
| 5,780,791 | 7/1998 | Cole | 200/38 R |
| 5,814,776 | 9/1998 | Worley | 200/38 R |
| 5,834,718 | 11/1998 | Amonett | 200/38 R |
| 5,861,590 | 1/1999 | Amonett | 200/38 B |

*Primary Examiner*—J. R. Scott
(74) *Attorney, Agent, or Firm*—Leydig, Voit & Mayer, Ltd.

(57) ABSTRACT

An appliance controller and its control shaft as well as a method for attaching a control knob to a control shaft are presented. The controller includes a control shaft body having a central bore and including at its forward end two cantilevers having outwardly facing detents. These detents are adapted to engage an engagement slot of a control knob. The control shaft body also includes at its rearward end two slots forming rear cantilevers having positioning detents. A locking rod is positioned within the bore of the control shaft body. It has a forward end adapted to prevent inward deflection of the forward cantilevers when it is in a locked position. This forward end is further adapted to preclude outward deflection of these cantilevers during insertion. The rearward end of the locking rod includes radially extending tabs which prevent the locking rod from being removed from the housing of the controller. This configuration allows for the securing of the control knob on the shaft from the front of the appliance by simply inserting the knob on the end of the shaft, and pushing the shaft to its retracted position. The positioning detents are then forced to engage the radially extending tabs to lock the rod in the locked position, preventing subsequent removal of the knob.

24 Claims, 12 Drawing Sheets

SELF LOCKING KNOB ATTACHMENT SHAFT FOR PROGRAM TIMERS

RELATED APPLICATIONS

This application is related to U.S. provisional application Ser. No. 60/113,829, filed Dec. 23, 1998, now abandoned, and U.S. provisional application Ser. No. 60/121,094, filed Feb. 22, 1999, now abandoned, the teachings and disclosures of which are hereby incorporated in their entireties by reference thereto.

FIELD OF THE INVENTION

In the instant invention relates to manually actuated program controls, and more specifically to user interface knob locking mechanisms for use therewith.

BACKGROUND OF THE INVENTION

Program controls, especially those used in the appliance industry, typically include a control section which receives user input via a user-actuated knob coupled through a control shaft. The technology utilized for the control mechanism varies depending upon the cost and sophistication of the particular application, and may include cam operated timers or electronic controls. A common feature of these control mechanisms however, is that they operate based upon a rotational position of a control shaft through which a user selects the particular cycle desired. A familiar application of such controls is in a typical washer or dryer used in home and industry.

One of the most common user interfaces utilized in the appliance industry is the push/pull control interface. This popular control interface utilizes a user actuated control knob coupled to the control shaft of the program control. The various cycles available are selected by the user by pushes the control knob inward followed by a rotation thereof to the desired program cycle as displayed to the user on the front control panel of a typical washer or dryer. Once the user control knob has been rotated to the appropriate position as typically indicated by a selector line on the control knob, the user then pulls the control knob outward to begin the selected program cycle. If, at any point during the operation of the appliance, the user decides to terminate the current cycle, the user simply pushes in on the control knob to interrupt the operation of the appliance.

As can be well imagined, there must be some mechanism to hold the user interface control knob onto the control shaft to allow for proper operation of the controller without having the control knob pulled off the control shaft. This mechanism must also allow for the control knob to be moved from the control shaft to accommodate removal of the appliance control from the control panel in the event of failure thereof. While a control panel could include a hole of suitable diameter to allow the control knob to be pulled therethrough, such does not present an aesthetically desirable configuration. Therefore, a typical appliance includes a small hole through the front control panel of a size sufficient only to accommodate the control shaft itself, and not the much larger control knob. The primary mechanism for holding the control knob on the control shaft is a simple friction fit between the outer diameter of the control shaft and the inner diameter of the control knob. In this way, the unit is assembled by forcing the control knob on the end of the control shaft once assembled in the control panel of the appliance. Obviously, the force of friction holding the control knob on the control shaft must be greater than the force required to be applied by a user in pulling the knob outward to interrupt a current cycle or allow for selection of a new cycle during normal operation. With this friction fit it is still possible to remove the control knob from the control shaft to allow for servicing or replacement of the appliance control by applying sufficient force to overcome the force of friction holding the knob thereon.

A problem exists with this design however, in that, over time, the fit between the outer diameter of the control shaft and the inner diameter of the control knob becomes worn. Once this begins to happen, pulling of the control knob to interrupt the current cycle tends to also remove the control knob from the end of the control shaft. While this situation is initially only a slight inconvenience for a user requiring only that he force the control knob back on the control shaft, once this process has been repeated a few times the inner diameter of the control knob becomes more and more worn to the point where pulling on the control knob no longer actuates the control shaft to interrupt the current cycle. Once this occurs, the consumer is forced to either replace the controller, the knob, or utilize a pair of pliers or other mechanism to properly actuate the control shaft. While all of the above are workable solutions to this problem, the increased cost and aggravation associated with the primary user interface tends to deteriorate the appliance manufacturer's reputation in the market and destroys product loyalty as dissatisfied consumers voice their discontent.

In an attempt to overcome this problem associated with a friction fit between the control knob and the control shaft of a program controller for an appliance, many of the plant manufacturers are now utilizing a more active mechanism to retain the control knob on the control shaft once the controller has been mounted on the appliances control panel. While a snap fit or other locking mechanism could be appropriate to overcome this problem, the serviceability requirements of the controller on a consumer appliance requires that the control knob be removable for service without damage to either the control shaft or the control knob. To accommodate this serviceability requirement, many control shafts are now being designed with flexible cantilevers at the end of the control shaft which have locking barbs on the end thereof which securely engage a recess in the inner diameter of the control knob. As the control knob is slid onto the end of the control shaft, the flexible detents deflect inwardly until the recess on the inner diameter of the control knob is reached at which point the cantilevers are allowed to flex to their normal position with their locking barbs engaging this recess. Once the knob has been inserted on the end of the control shaft, a locking pin is inserted through the control shaft to come to rest between the flexible cantilevers to prevent their deflection inwardly, thus preventing the control knob from being removed from the end of the control shaft without the use of excessive force to a degree resulting in damage of the control knob, control shaft, or both.

One such control shaft is illustrated in U.S. Pat. No. 5,684,281 issued to Amonett on Nov. 4, 1997, for a TIMER CAMSTACK AND CLUTCH. In this design, a shaft locking pin is inserted through the hollow control shaft to be positioned between the two flexible cantilevers to prevent their inward deflection to retain the control knob positioned on the end thereof. The locking pin is held in place by a locking pin groove situated on the end of the locking pin which then engages two ribs on the inner surface of the flexible cantilevers. However, this design suffers from problems which makes its utilization in consumer and commercial appliance applications disadvantageous.

First, because the flexible cantilevers must include a rib on the inner surface to engage the locking pin groove, insertion of the locking pin must necessarily deflect the cantilevers in an outward direction upon insertion of the locking pin. To accommodate such outward deflection until the locking pin groove engages the ribs, the inner diameter of the user control knob must necessarily be slightly larger than would be necessary to accommodate the outer diameter of the cantilevers. This results in some unnecessary play in the fit of the control knob on the control shaft giving the impression of substandard quality. Alternatively, if the inner diameter of the control knob is made to fit more solidly on the end of the control shaft, the insertion of the locking pin will result in damage or at least increased wear on the ribs on the inner surface of the cantilevers, as well as on the end of the locking pin itself. Such wear will ultimately result in failure of the ribs and an inability to lock the control knob in place.

A second significant problem exists with this design related to the securing of the locking pin within the cantilevers of the control shaft. Specifically, since the insertion of the locking pin between the cantilevers having the rib on the inner surface thereof must result in an outward deflection of these cantilevers, an assembler may well believe that the increase resistance to the insertion of the locking pin is a result of the pin being locked in place. If this is assumed by an assembler, it is simply a matter of time before the inward force on the cantilevers by the control knob will work the locking pin far enough from the ends of the cantilevers that the control knob will eventually be pulled off by a user attempting to interrupt a cycle in progress or otherwise manipulating the control knob. In this situation, unlike the older style friction fit, reapplication of the control knob will not allow proper operation, as the cantilevers will easily flex to allow the control knob to be removed from the shaft.

Since the consumer has no way of reinserting the locking pin into the secured position in the control shaft, the consumer will be forced to request a service call. The requirement for a service call stems from the design of the locking pin which is freely inserted and removed from the back of the assembled appliance control. Since the assembled appliance control is installed on the reverse side of the appliance control panel, a service repair person will be required to remove the appliance control panel to simply reinsert the locking pin in place once the control knob has been reinserted on the control shaft. Considering that a typical service call costs between $50.00 and $100.00 at today's going rate, the profitability of an appliance incorporating such a design when the service calls are taken into account falls to an unacceptably low level. Likewise, the cost of ownership for a consumer, in view of the cost of a service call to replace a simple locking pin, becomes unacceptably high after the first such event. Even if a consumer learns how to remove the front control panel, reset the locking pin, and replace the control panel without inadvertently pinching or disconnecting any control wiring, the shear hassle involved in removing and replacing the front control panel from a consumer appliance, not to mention the safety risk associated with an untrained consumer removing the front control panel from an electrical device, will greatly decrease consumer loyalty and the manufacturer's reputation in the market place. As a result, this design is unacceptable from reliability and cost of ownership stand point, as well as from of a perceived quality and reputation stand point.

There continues to exist a need for a retaining mechanism for user control knobs for push/pull type controllers which will adequately retain the user control knob during normal operation of the control mechanism, and which allows for easy user replacement of the control knob should it become disengaged from the control shaft without the necessity of a service call or removal of the front control panel of an appliance.

SUMMARY OF THE INVENTION

In view of the above, it is an objective of the instant invention to provide a new and improved knob retention feature for control shafts. More particularly, it is an objective of the instant invention to provide a knob retention feature for use with an appliance program timer of the type which may be pushed or pulled and rotated in either direction without having the knob coming off the shaft. It is a further object of the instant invention to obviate the necessity of a service call in the event that the control knob is removed from the control shaft by allowing reinstallation of the control knob by the user without the necessity of removing the front control panel to gain access to the rear of the appliance controller. It is a further object of the instant invention to provide this knob retention feature in a captured fashion to prevent the loss and ease in the manufacture and shipping of control shaft component parts. It is a further object of the instant invention to provide ease of maintenance and disassembly thereby reducing the overall cost of ownership of the appliance into which the instant invention is installed.

In view of the above, it is a feature of the instant invention to provide a knob retention mechanism for an appliance control timer which allows for installation and locking in place of the control knob by simply pushing the knob onto the control shaft such that the control shaft is positioned into its retracted position. It is a further feature of the instant invention that, should the control knob become disengaged from the control shaft, a consumer may readily reattach the control knob without requiring that the front panel be removed to gain access to the control shaft locking pin as was required by prior designs. It is a further feature of the instant invention to provide a second mechanism for locking the control knob in place from the rear of the appliance control timer assembly. It is a further feature of the instant invention to provide a captured locking pin within the control shaft to prevent loss thereof. It is an additional feature of the instant invention that the locking pin of the control shaft may be stowed in an unlocked position to allow for ease of assembly and removal of the user control knob.

In a preferred embodiment of the instant invention, a control shaft for coupling user program selection information from a control knob to a program controller, the control knob having an engagement slot within its inner periphery, comprises a control shaft body defining a central bore. The control shaft body includes at its forward end at least two cantilevers. The cantilevers have outwardly facing detents adapted to engage the engagement slot of the control knob. The control shaft body further includes at a rearward end at least one slot communicating with the central bore and including positioning detents. Further, the control shaft comprises a locking rod positioned within the bore of the control shaft body. The locking rod has a forward end adapted to prevent inward deflection of the cantilevers of the control shaft body when the locking rod is in a locked position. The forward end of the locking rod is further adapted to preclude outward deflection of the cantilevers during its insertion thereof. The locking rod is secured in the locked position by the positioning detents.

In an highly preferred embodiment, the locking rod further comprises positioning shoulders adapted to engage the slot of the control shaft body. These positioning shoulders cooperate with the positioning detents to maintain the locking rod within the central bore at a position allowing inward deflection of the cantilevers. Further, the positioning shoulders include a forward surface profiled to cooperate with the positioning detents to ease insertion of the locking rod into the central bore, and a rearward surface profiled to interfere with the positioning detents to obstruct removal of the locking rod from the central bore. Additionally, the locking rod further comprises at least one rearward end tab to engage the slot of the control shaft body. This rearward end tab further cooperates with the positioning detents to maintain the locking rod within the central bore at the locked position. This rearward end tab preferably includes a forward surface profiled to cooperate with the positioning detents to ease insertion of the locking rod into the central bore, and a rearward surface profiled to interfere with the positioning detents to obstruct removal of the locking rod from the central bore. In a highly preferred embodiment, the control shaft body further defines a second slot opposite the at least one slot forming a pair of rearward cantilevers. The positioning detents are preferably formed on edges of the rearward cantilevers at the slots such that the rearward cantilevers are outwardly deflected only by the positioning shoulders and the rearward end tabs.

A program controller in accordance with a preferred embodiment has at least one cycle program operably stored therein, the selection of the cycle program being performed by user rotation of a control knob, the control knob including an engagement slot within its inner periphery. This program controller in accordance with a preferred embodiment of the invention comprises a housing, a control shaft body having a central bore. The control shaft body also includes a forward end extending through a front of the housing and defining at least two cantilevers. These cantilevers have outwardly facing detents adapted to engage the engagement slot of the control knob. The control shaft body further includes at a rearward end positioning detents. A locking rod is positioned within the bore of the control shaft body. The locking rod has a forward end adapted to prevent inward deflection of the cantilevers of the control shaft body when the locking rod is in a locked position, and is further adapted to preclude outward deflection of the cantilevers during its insertion. The locking rod is secured in the locked position by the positioning detents.

In a preferred embodiment, the housing includes a rearward cover, and the control shaft body may be linearly translated within the housing in a forward and a rearward direction. Preferably, the rearward cover cooperates with the end tab during rearward translation of the control shaft body to position the locking rod in the locked position. Further, the rearward cover captures the locking rod within the housing.

A method of securely attaching a control knob on a control shaft of a program controller in accordance with a preferred method of the instant invention comprises the steps of inserting the control knob on a forward end of the control shaft to allow the internal slot to engage the detents on the end of the cantilevers on the forward end of the control shaft, and pushing the control knob to linearly translate the control shaft to a retracted position whereby the locking rod is positioned between the cantilevers thereby preventing inward deflection of the cantilevers to preclude removal of the control knob. Further, the method comprises, before the step of inserting the control knob on a forward end of the control shaft, the steps of pulling the control shaft to an extended position, and pushing the locking rod rearward to allow inward deflection of the cantilevers.

These and other aims, objectives, and features of the invention will become more apparent from the following detailed description when taken in conjunction with the accompanying drawings.

Figure 1:
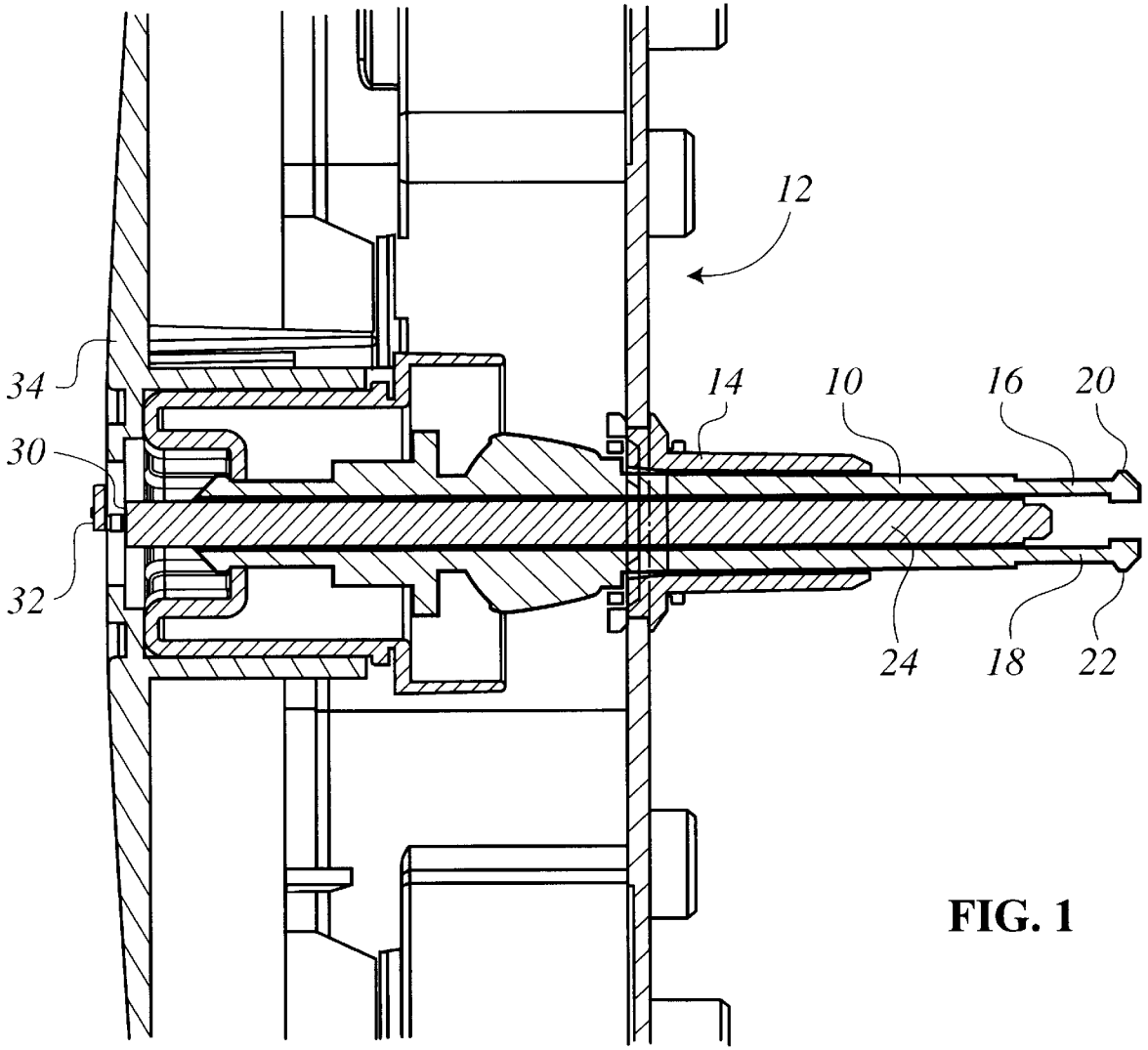
FIG. 1 is a partial cross sectional view of an appliance control timer constructed in accordance with the teachings of the instant invention illustrating the control shaft in an unlocked position.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

A preferred embodiment of the instant invention particularly suited for application in the appliance industry is illustrated in cross section in FIG. 1 to which specific reference is now made. As may be seen, the main body 10 of the control shaft is installed within a typical appliance timer control 12 through a control shaft mounting shank 14. The main body 10 of the control shaft terminates at an outer most or forward end in two parallel cantilevers 16, 18, each of which includes an outward projection 20, 22 which is used to engage an inner recess or engagement slot of the user control knob (not shown) to retain the control knob thereon. This retention is ensured through the use of a locking rod 24 which is inserted through a bore in the control shaft main body 10 as will be described more fully hereinbelow. The cross sectional illustration of FIG. 1 illustrates the locking rod 24 in a stowed position allowing the control knob (not shown) to be installed and removed on the end of the control shaft 10.

This installation and removal of the user interface control knob (not shown) is effectuated by the parallel cantilevers 16, 18 which are allowed to deflect inwardly as the control knob is inserted onto and removed from the forward end of control shaft 10. Once fully installed, the outward projections 20, 22 on the end of cantilever 16, 18 engage the slot engagement in the inner periphery of the control knob, allowing the cantilevers 16, 18 to return to their non-inwardly deflected or quiescent position. Likewise, the removal of the control knob from the end of control shaft 10 also result in an inward deflection of cantilever 16, 18 as the portions 20, 22 move along the smaller inner diameter surface of the control knob. It will be noted by one skilled in the art that regions 20, 22 are profiled to allow a smooth transition into and out of the engagement slot on the inner circumference of the control knob without catching or hanging up. This provides both ease of installation as well as removal of the control knob for maintenance or replacement.

Figure 2:
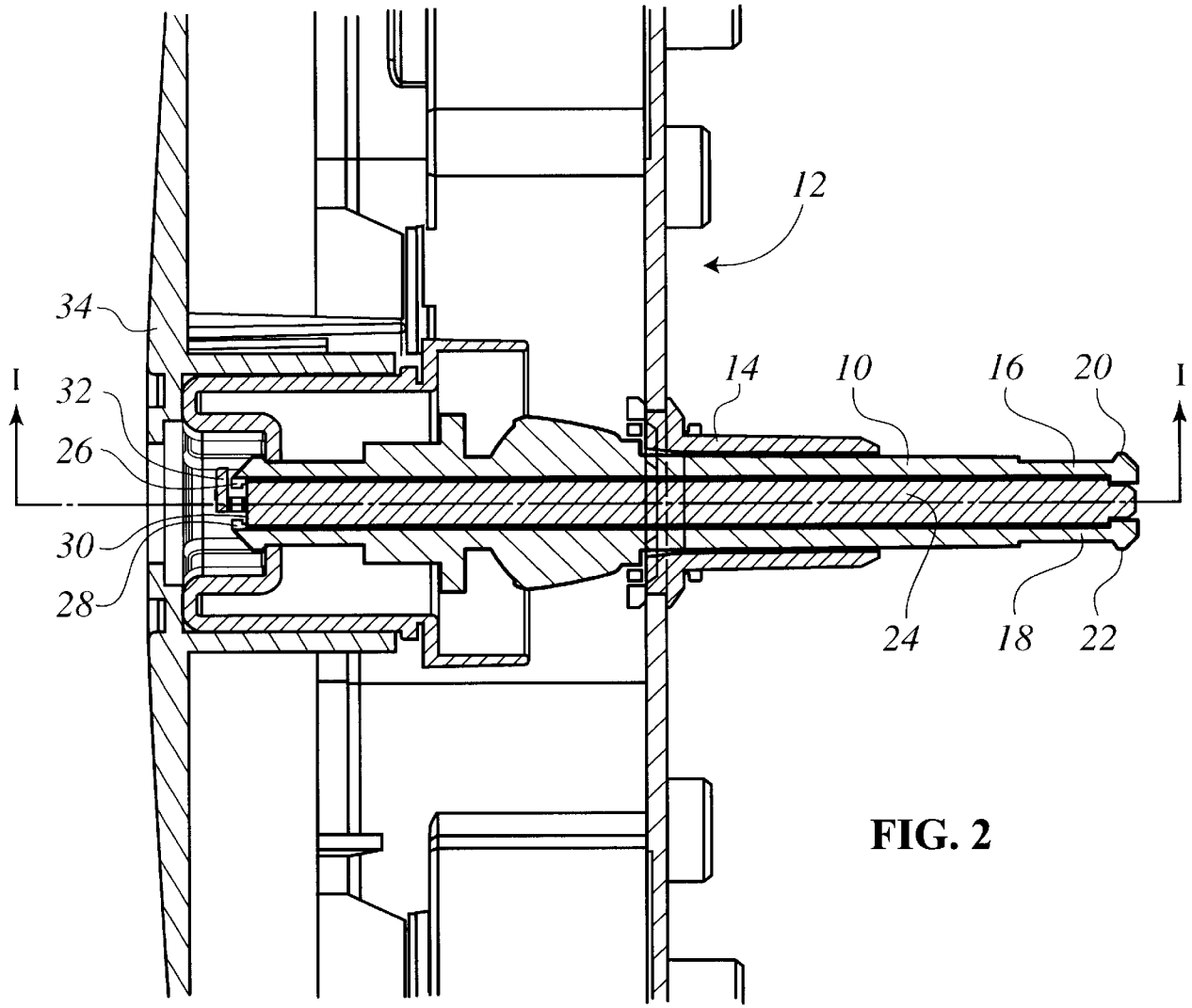
FIG. 2 is a partial cross sectional view of the appliance control timer of FIG. 1 illustrating the control shaft in a locked position.
Figure 8:
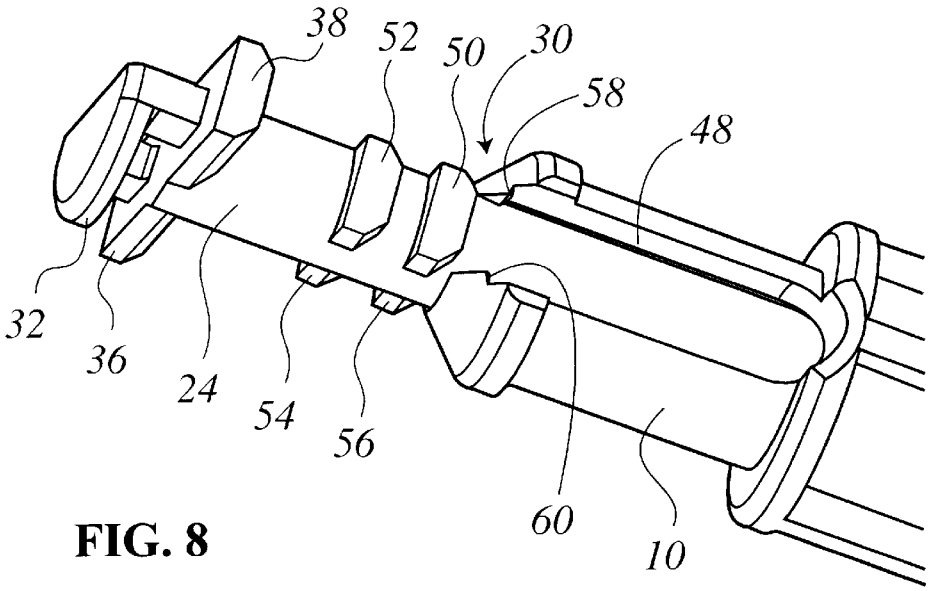
FIG. 8 is a partial isometric view of an embodiment of the instant invention.

Once the control knob has been placed on the shaft 10, the locking rod 24 is further inserted into the control shaft 10 positioning itself between the cantilevers 16, 18 to prohibit inward deflection thereof as illustrated in FIG. 2. Once so positioned, the control knob may not be removed from the end of control shaft 10 because portions 20, 22 cannot be displaced out of the slot along the inner circumference of the knob. The locking rod 24 is held in this locked state by detents 26, 28 on the opposite or rearward end of control shaft 10 from the cantilevers 16, 18. These detents 26, 28 engage the end 30 of locking rod 24 to prevent it from moving out of the locked position between cantilevers 16, 18. The details of this engagement will be described more fully below with respect to FIGS. 8 and 9. One skilled in the art will also note from FIGS. 1 and 2 that the locking rod 24 includes a removal tab 32 on rearward end 30 which allows maintenance personnel to remove the locking rod 24 from its secured position illustrated in FIG. 2 to its stowed position illustrated in FIG. 1, and to fully remove the locking rod 24 from the control shaft body 10. As will become apparent more fully hereinbelow, the removal of locking rod 24 may only be accommodated in this embodiment if the back cover 34 of the appliance controller 12 is removed.

Figure 3:
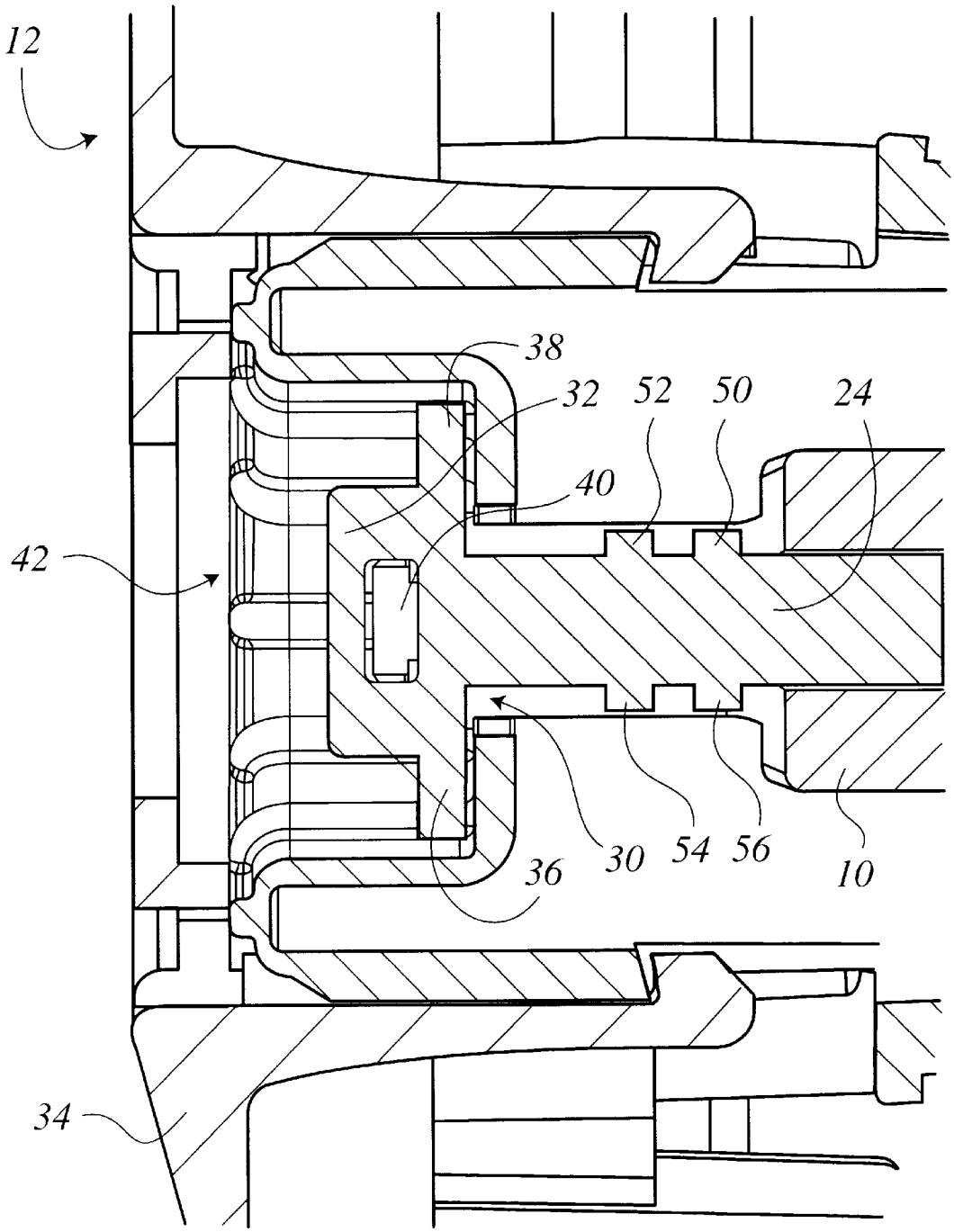
FIG. 3 is an enlarged partial cross sectional view of a portion of the control shaft and timer control mechanism illustrating the control shaft in an extended position in accordance with the teachings of the instant invention.

The necessity of removing the back cover 34 will become apparent to one skilled in the art from an analysis of the partial cross section illustration of FIG. 3 which details rearward end 30 of the control rod 24 in an orientation rotated 90° about the long axis I—I of the locking rod 24 as illustrated in FIG. 2. As may be seen from this orientation, the locking rod 24 includes tabs 36, 38 extending from end 30 of locking rod 24. As also may be seen from this FIG. 3, the removal tab 32 defines therein an aperture 40 therethrough which aids in the removal of locking rod 24 from the control shaft body 10 by allowing insertion of a tool, such as, for example, a screwdriver or other tool. It is noted that the control shaft 10 is illustrated in an extended position in FIG. 3. The tabs 36, 38 are accommodated in this extended position within housing well 42 which is of a diameter sufficient to allow full rotation of tabs 36, 38 as the control shaft 10 is rotated by the user.

Figure 4:
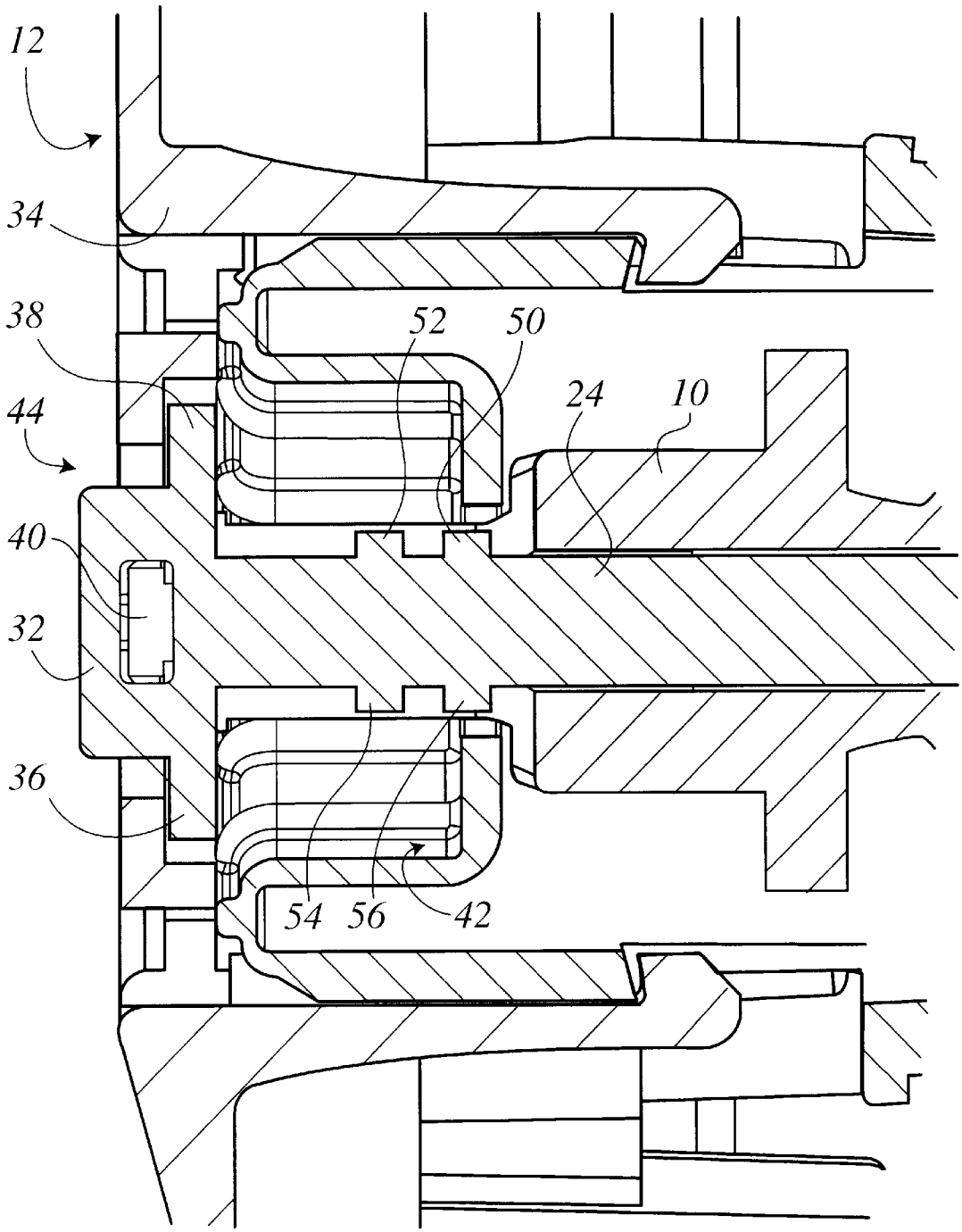
FIG. 4 is an enlarged partial cross sectional diagram as in FIG. 3 illustrating the control shaft in a retracted position in accordance with the teachings of the instant invention.

Once a user has pushed the control shaft 10 into its retracted position as illustrated in FIG. 4, the cooperation of the back cover 34 of appliance controller 12 becomes apparent. Specifically, in a preferred embodiment of the instant invention the back cover 34 of the appliance controller 12 includes an opening 44 through which removal tab 32 of locking rod 24 may extend. However, it is noted that the opening 44 has a diameter which is less than the outside diameter of locking rod 24 as measured at its tabs 36, 38. In this way, the locking rod 24 may be captured within the appliance controller 12 so that it may not fall out and become lost during shipping of the controller assembly 12, or during maintenance of the appliance itself. However, the diameter of opening 44 in the back cover 34 of the appliance controller 12 is sufficient to allow insertion of a tool (not shown) to engage removal tab 32 or aperture 40 to allow disengagement of the locking rod 24 from its locked to its stowed position. Further, as will become apparent from the description of FIG. 7 below, this narrowed diameter opening 44 also allows for reinstallation of the control knob from the front of the appliance controller 12 in the field without the necessity of removing the front control panel from the appliance as was typically required with prior systems.

Figure 5:
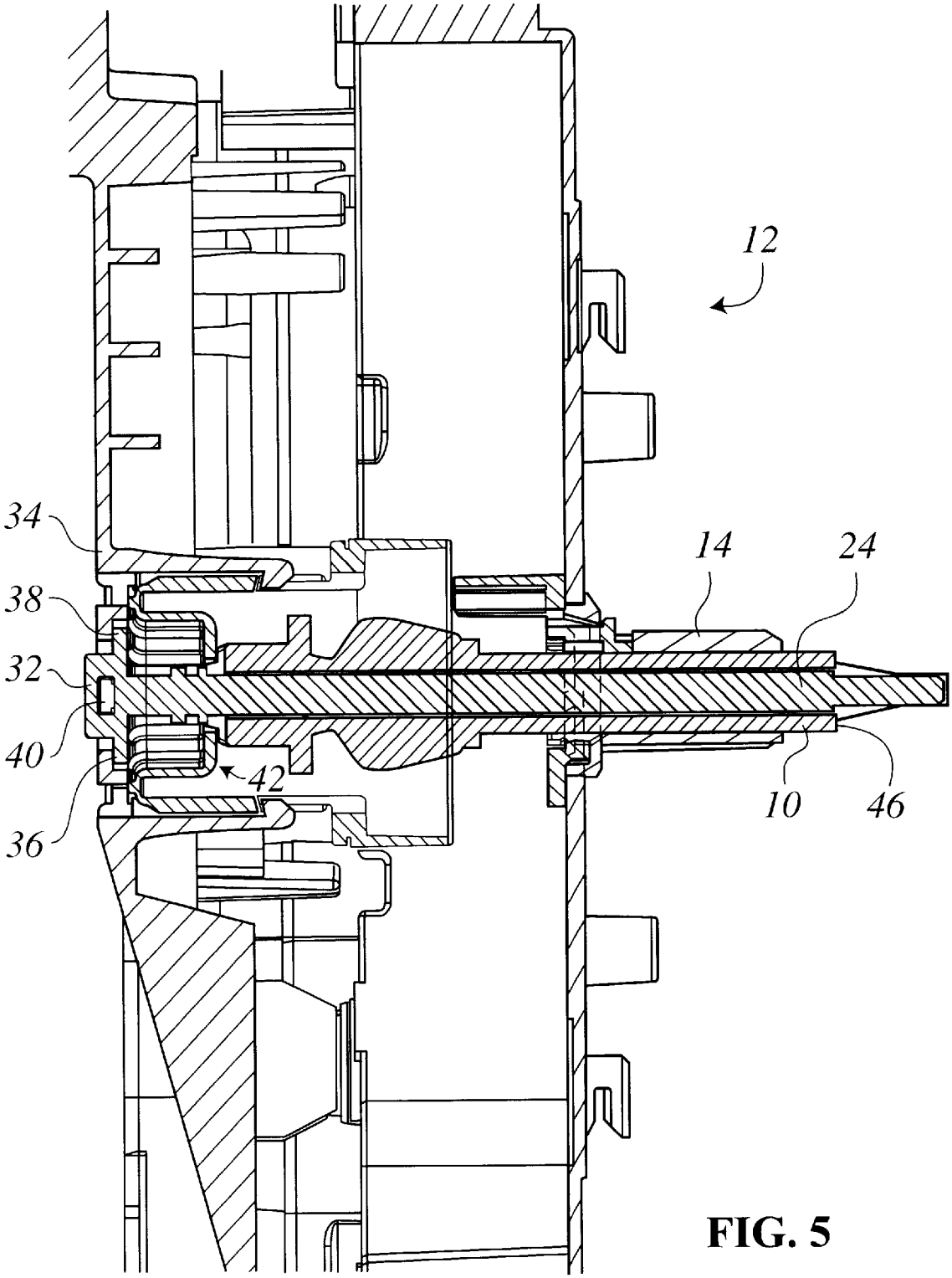
FIG. 5 is a partial cross sectional diagram of the embodiment of the instant invention of FIG. 1 rotated 90° and illustrating the control shaft in a retracted position.
Figure 6:
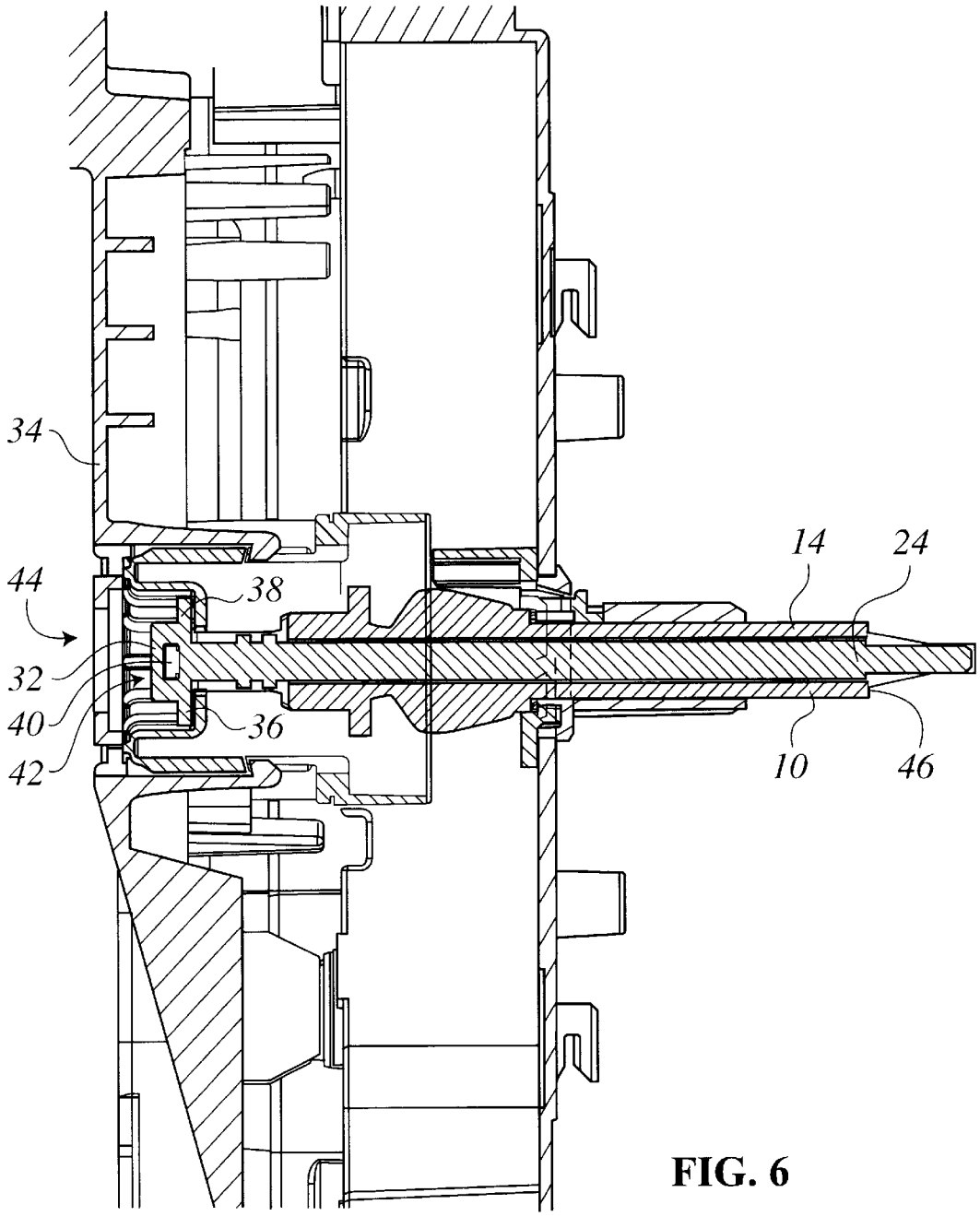
FIG. 6 is a partial cross sectional view of the embodiment of the instant invention illustrated in FIG. 5 illustrating the control shaft in an extended position.

FIG. 5 illustrates a complete cross section of the locking rod 24 and control shaft 10 along the same orientation as illustrated in the partial cross sectional diagrams of FIG. 3 and 4. As may be seen from this FIG. 5, the end 46 of control shaft 10 is profiled to allow insertion of the control knob thereon. Such profiling allows for a standard rectangular shaped insertion slot of a typical control knob to be fitted thereon, although it must be noted that other end configurations are possible. However, it is noted that the rectangular shaped slot on a typical control knob provides good torque transfer between the user interface control shaft 10 and the knob. FIG. 6 provides a cross sectional view similar to that illustrated in FIG. 5 but with the control shaft 10 in its extended position.

Figure 7:
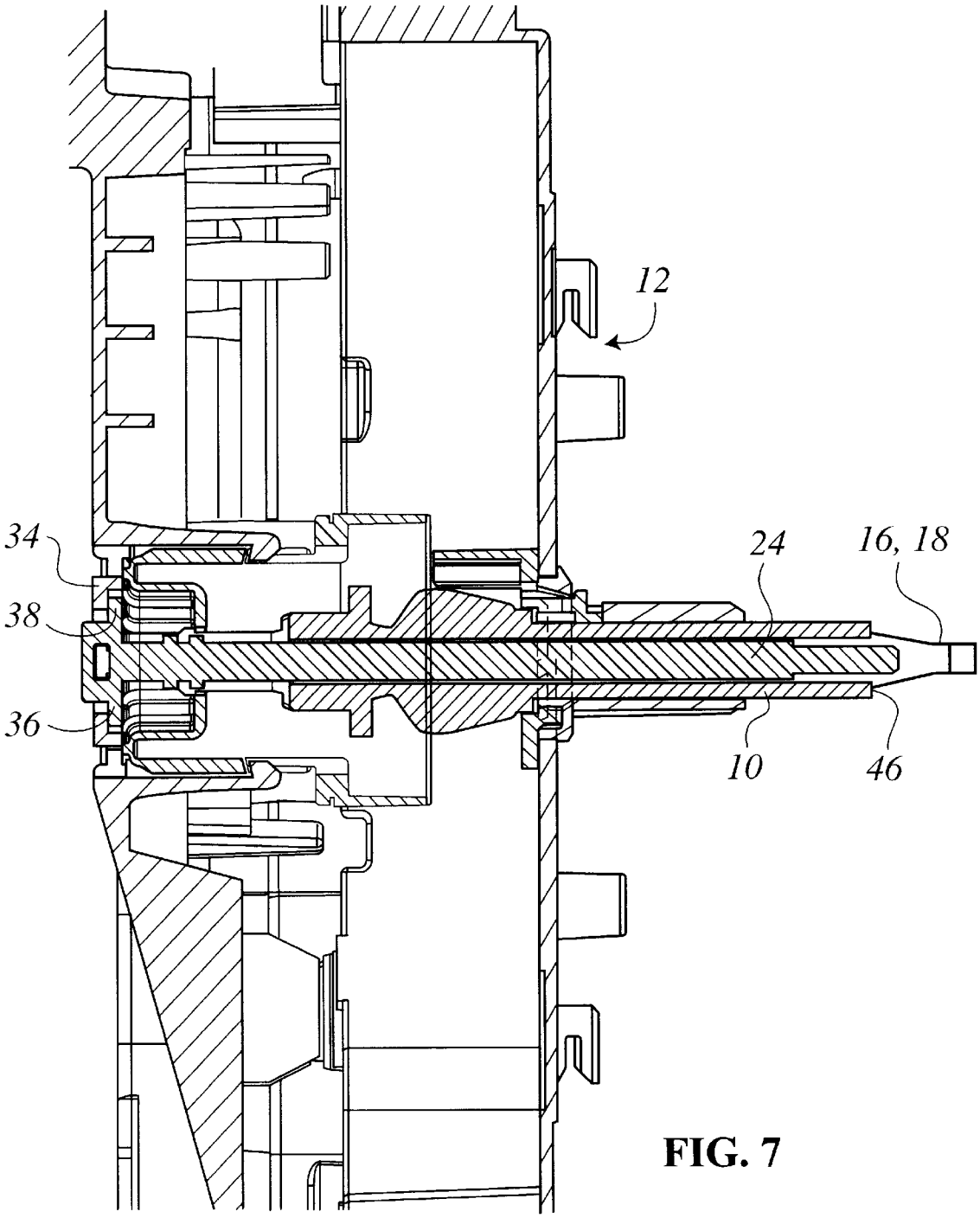
FIG. 7 is a partial cross sectional view of an embodiment of the instant invention illustrating the control shaft locking pin in a stowed position within the control shaft.

FIG. 7 also illustrates a cross section of the control shaft 10 in the same orientation as illustrated in FIGS. 5 and 6. however, FIG. 7 illustrates the locking rod 24 in its stowed position as was illustrated in FIG. 1. As may be seen from this FIG. 7, a significant advantage of this embodiment of the invention may be realized. Specifically, in this stowed position the control knob may be installed on and removed from the forward end 46 of control shaft 10 as described above. Further. in cooperation with the back cover 34 of the appliance controller 12 the tabs 36, 38 prevent further translation in the rearward direction of locking rod 24 if the control shaft 10 is pushed inward by the user. This allows the user to reinstall the control knob on the end 46 of the control shaft 10 by simply pushing the knob thereon and forcing the control shaft 10 to its retracted position. Since the locking rod 24 may not be translated any further rearward due to the contact of tabs 36, 38 with the back cover 34, the retraction of the control shaft 10 results in the locking rod 24 being positioned between cantilevers 16, 18, thereby preventing removal of the control knob from the end 46 of the control shaft 10. When the control shaft 10 is fully retracted, the locking rod 24 becomes locked into its locked position, thereby preventing further removal of the control knob from the forward end 46 of the control shaft 10. This feature offers significant cost savings to a consumer who no longer needs to contact a repair person to reinstall the knob on the end of the control shaft as was required with prior systems. Specifically, the control knob may now be reinstalled onto the end of the control shaft and locked into place without the necessity of removing the front control panel of the appliance to gain access to the back of the appliance controller to lock a locking pin in place to prevent further removal of the control knob.

The actual method of reattaching the control knob if, for any reason, it becomes removed from the end of the control shaft 10 simple requires the user to pull out on the control shaft 10 to place it in its extended position. Once the control shaft 10 has been fully extended, the user may then push the locking rod 24 rearward if it is currently positioned between the cantilevers 16, 18. As described above, this will allow the control knob to be slipped onto the end 46 of the control shaft 10 with ease due to the inward deflection of the cantilevers 16, 18. Once the locking rod 24 has been pushed rearward to allow inward deflection of the cantilevers, the user would simply position the control knob on the forward end of the control shaft 10 and push the knob to retract the control shaft 10. Once the control shaft has been placed in its retracted position, the locking rod 24 will have been positioned between the cantilevers 16, 18 and locked into place within the control shaft 10 thereby preventing further removal of the control knob from the end 46 of the shaft 10. This is a greatly simplified procedure which does not expose a user to the expense of a service call nor to the dangers of removing the control panel to gain access to the rear thereof. Instead of waiting days for a service call or spending hours removing the front control panel to reattach a dislodged control knob, the instant invention allows reattachment through this simple method in a matter of mere seconds.

As eluded to above, the mechanism which allows the locking rod 24 to be positioned in either a stowed or locked state is provided through a cooperation of the control shaft body 10 and features of the locking rod 24. An understanding of these mechanisms may be gained from an examination of FIG. 8 to which specific reference is now made. As may be seen from this partial isometric view of the rearward end 30 of control shaft 10 and locking rod 24, the control shaft body 10 includes a slot or channel 48 which accommodates locking rod positioning shoulders 50, 52, 54, 56, and tabs 36, 38 therein. The end 30 of control shaft housing 10 also includes profiled detents 58, 60 which engage positioning shoulders 50, 52, 54, 56 to maintain the locking rod 24 in a stowed position. Specifically, as locking rod 24 is inserted within control shaft body 10 the profiled surface of detents 58, 60 are slightly outwardly deflected by positioning shoulders 50, 56. As locking rod 24 is further translated into control shaft body 10, the detents 58, 60 are allowed to return to their quiescent state between the two positioning shoulders 50, 52 and 54, 56. In this position the locking rod 24 is stowed within the control shaft body 10. In this stowed position additional force will be required to further insert the locking rod 24 into the control shaft body 10, and additional force will also be needed to remove the locking rod 24 from the control shaft body 10. Preferably, the positioning shoulders 50, 52, 54, 56 will also have a profiled surface which cooperates with the detents 58, 60 to allow slightly less force to be used to insert the locking rod 24 from that required to remove locking rod 24. In this way, the invention may be easily assembled, and is more difficult to disassemble.

Figure 9:
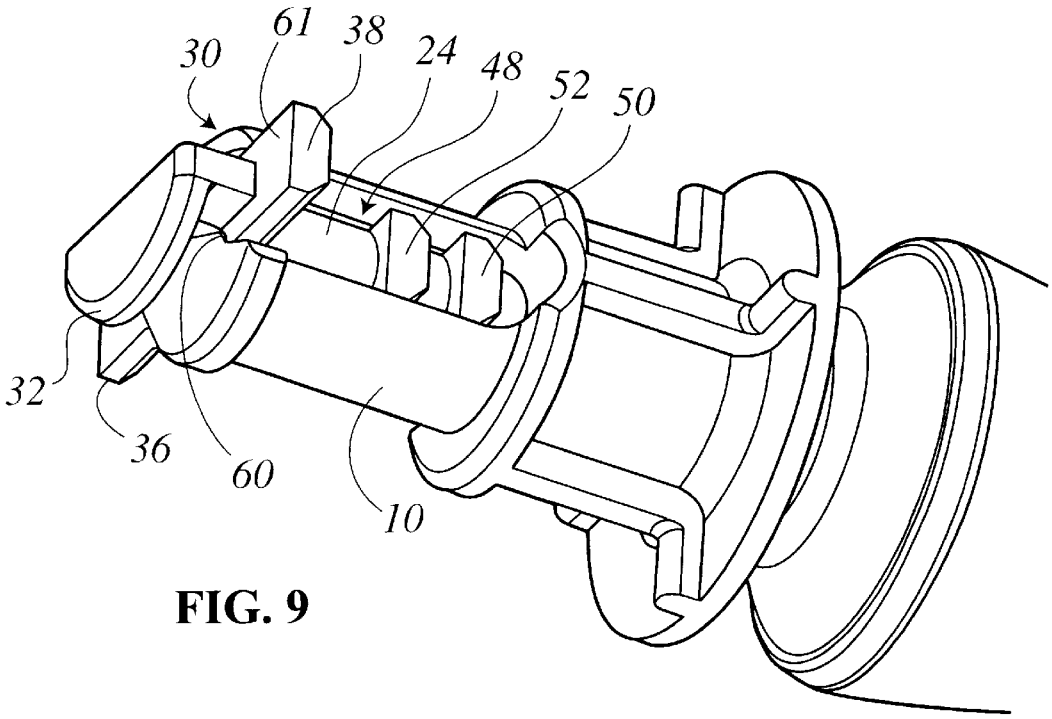
FIG. 9 is a partial isometric view of an embodiment of the instant invention illustrating the locking pin installed in a locked position within the control shaft in accordance with the teachings of the instant invention.

As the locking rod 24 is further inserted into the control shaft body 10, the detents 58, 60 will ultimately engage tabs 36, 38 to hold the locking rod 24 in its locked state as illustrated in FIG. 9. Preferably, the rearward surface 62 of tabs 36, 38 is profiled to require additional force to extract the locking rod 24 from the control shaft body 10. This will prevent the inadvertent disengagement of the locking rod 24 from its locked position and allowing the control knob to be removed inadvertently.

Figure 10:
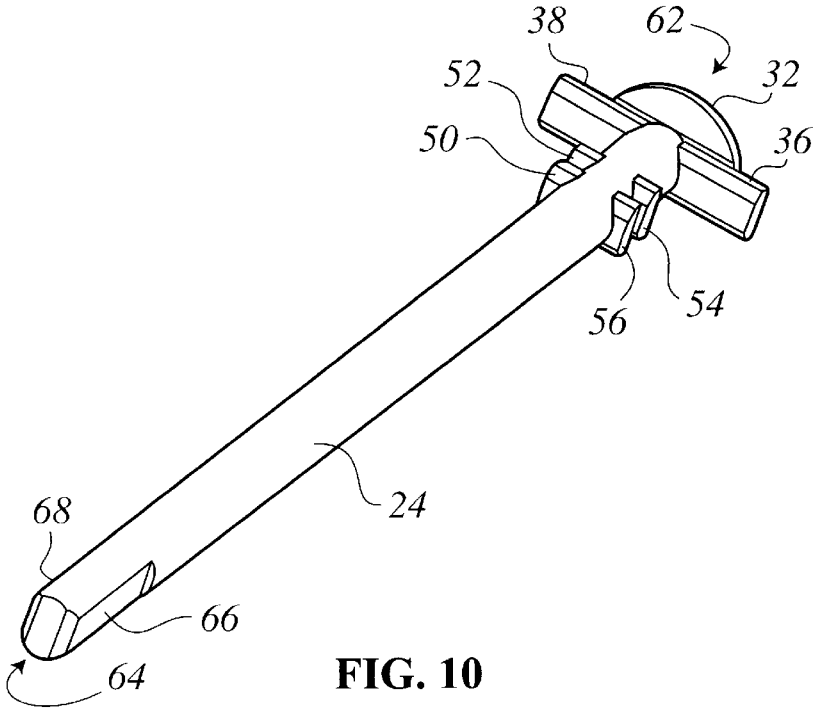
FIG. 10 is an isometric view of an embodiment of the locking pin of the instant invention.
Figure 11:
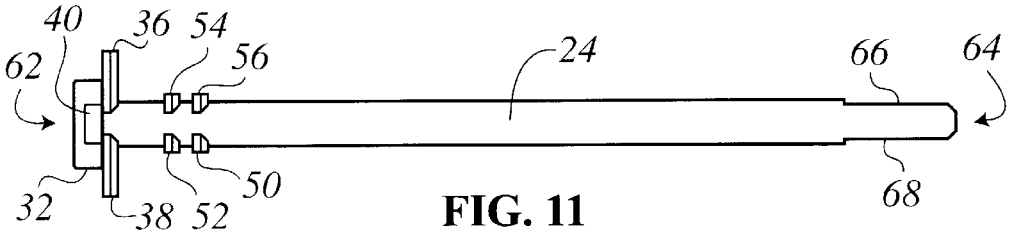
FIG. 11 is a side view of the embodiment of the locking pin of the instant invention as illustrated in FIG. 10.

An alternate embodiment of the locking rod 24 of the instant invention is illustrated in the isometric view of FIG. 10. As may be seen from this isometric view, the locking rod 24 includes the positioning shoulders 50, 52, 54, 56, as well as tabs 36, 38 as described above. Further, this configuration of locking rod 24 also includes removal tab 32 to assist in the removal of this locking rod 24 from the control shaft assembly (not shown). It is noted that these features are all provided on the rearward end 62 of locking rod 24, with "rearward" orientated according to the final installation in the appliance whereby the control knob securing end of the control shaft 10 would be considered the forward end as described above. With this orientation, it can be seen that the forward end 64 of locking rod 24 maintains a smooth outer diameter, and includes two profiled surfaces 66, 68 which are configured to accommodate the standard rectangular slot on a typical control knob. In this embodiment, which is illustrated in a side view in FIG. 11, it may be seen that these profiled surfaces 66, 68 extend axially along the length of locking rod 24 only far enough as is necessary to accommodate the insertion of the control knob.

Figure 12:
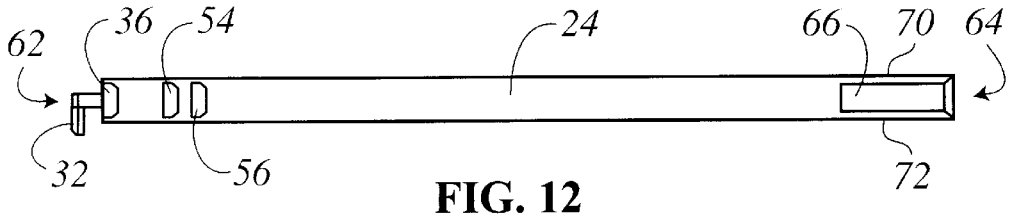
FIG. 12 is a side view of the embodiment of the locking pin illustrated in FIG. 10 rotated 90° about its long axis from that illustrated in FIG. 11.
Figure 13:
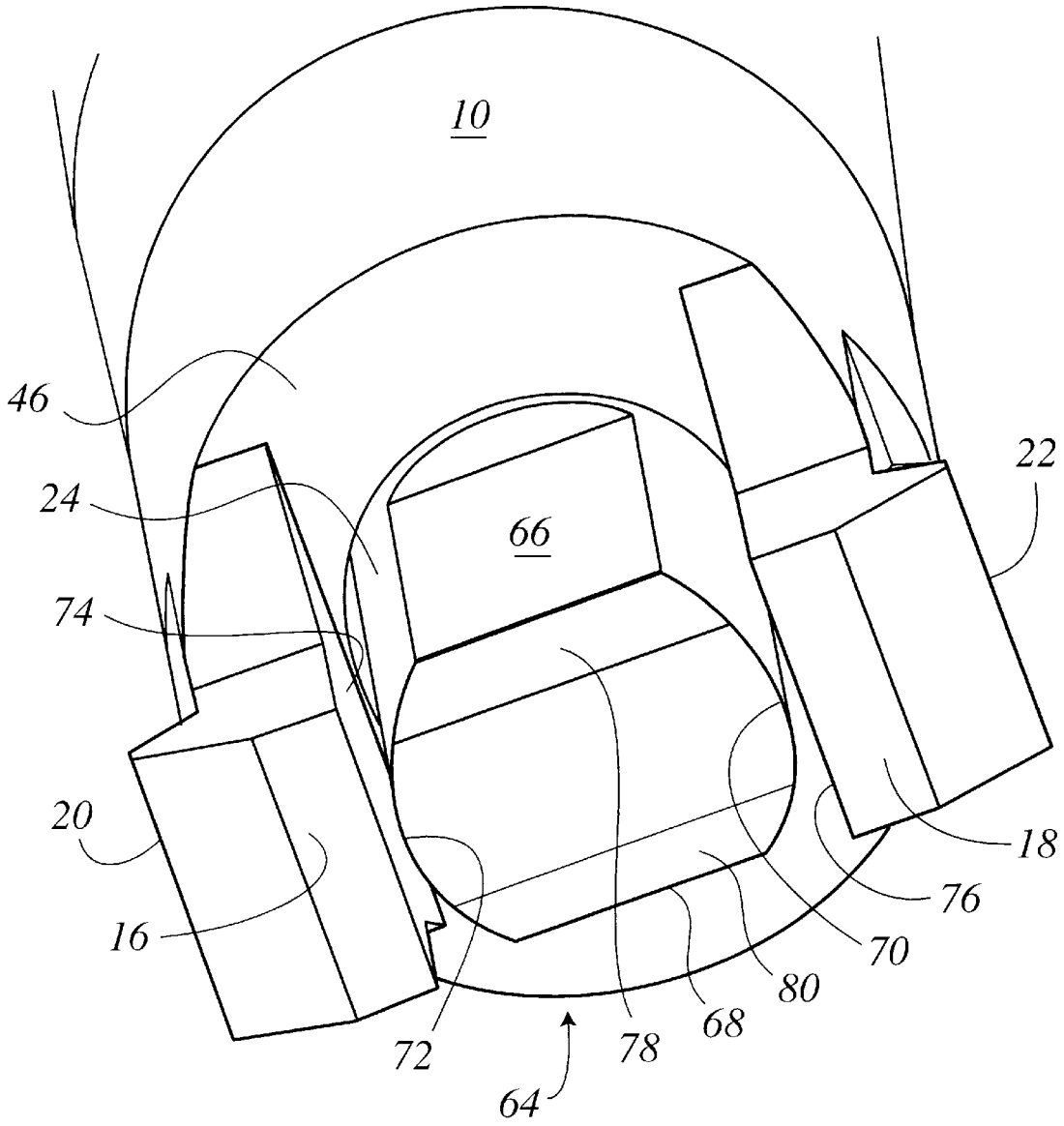
FIG. 13 is an enlarged partial isometric view of an end portion of the control shaft of the instant invention illustrating aspects of the invention.

An alternate side view of the embodiment of locking rod 24 rotated 90° about its long axis is illustrated in FIG. 12. As will be apparent from this orientation, the profiled surface 66 (68) exists on what may be termed the side of locking rod 24 to accommodate the rectangular shaped slot of the standard control knob. The non-profiled outer diameter surfaces 70, 72 provide the interference function in association with the cantilevers 16, 18 to prevent their inward deflection and removal of the control knob when the locking rod 24 is in its locked position. This may be seen in the partial isometric view of FIG. 13. As will be apparent to one skilled in the art from this FIG. 13, this embodiment of the locking rod 24 allows for a greatly simplified control shaft cantilever design as well. Specifically, with this embodiment of locking rod 24 the inner contact surfaces 74, 76 of cantilevers 16, 18 may be smooth, i.e., need not include any inwardly facing protrusion to contact locking rod 24. This allows for simplified manufacture of control shaft 10 as well as locking rod 24. Further, this embodiment provides smoother insertion of locking rod 24 within control shaft body 10 without the possibility of inadvertent catching or hanging up of the control rod 24 on such inwardly projecting elements. As may also be seen from this partial isometric view, this embodiment of locking rod 24 may also include angled end surfaces 78, 80 on its forward end 64 to allow for a smooth insertion of the control knob, aiding in the guidance of the slot to the proper insertion position.

Figure 14:
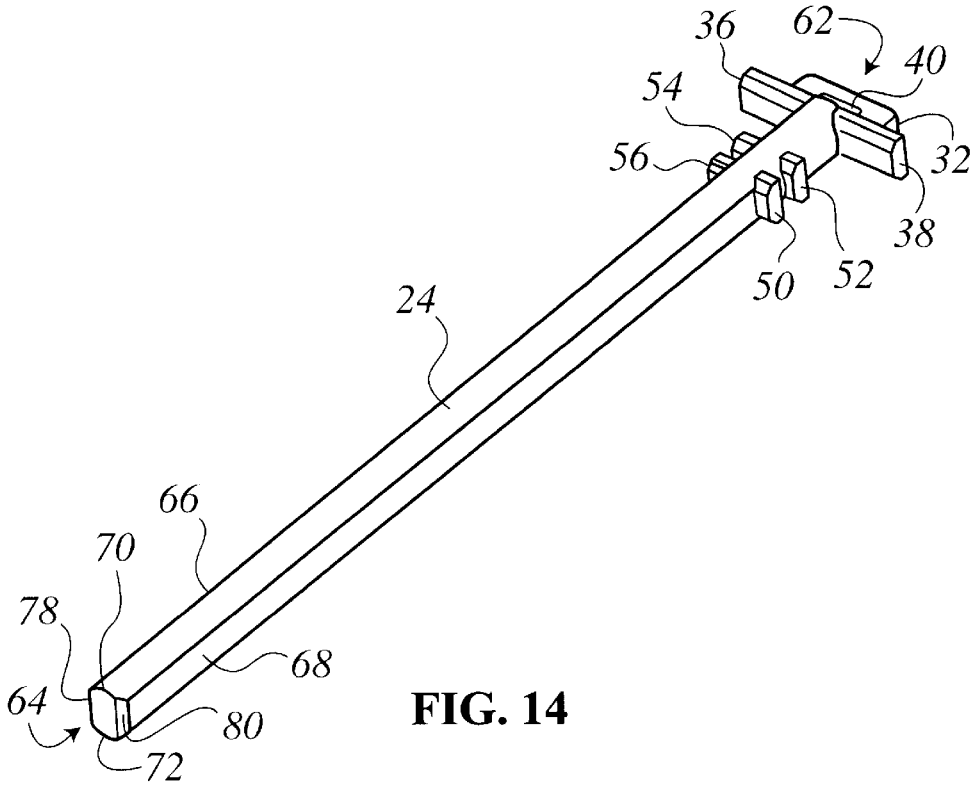
FIG. 14 is an isometric view of an alternate embodiment of a locking pin in accordance with the teachings of the instant invention.
Figure 15:
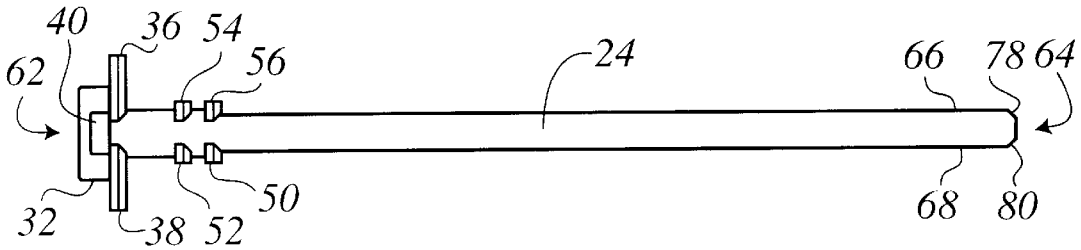
FIG. 15 is a side view of the embodiment of the locking pin of the instant invention as illustrated in FIG. 14.
Figure 16:
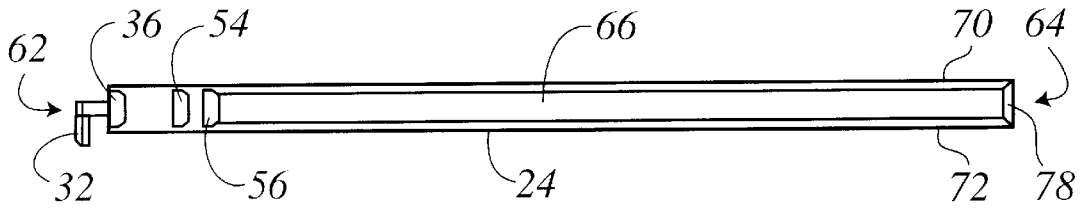
FIG. 16 is a side view of the embodiment of the locking pin of the instant invention illustrated in FIG. 14 rotated 90° about its long axis from that illustrated in FIG. 15.
Figure 17:
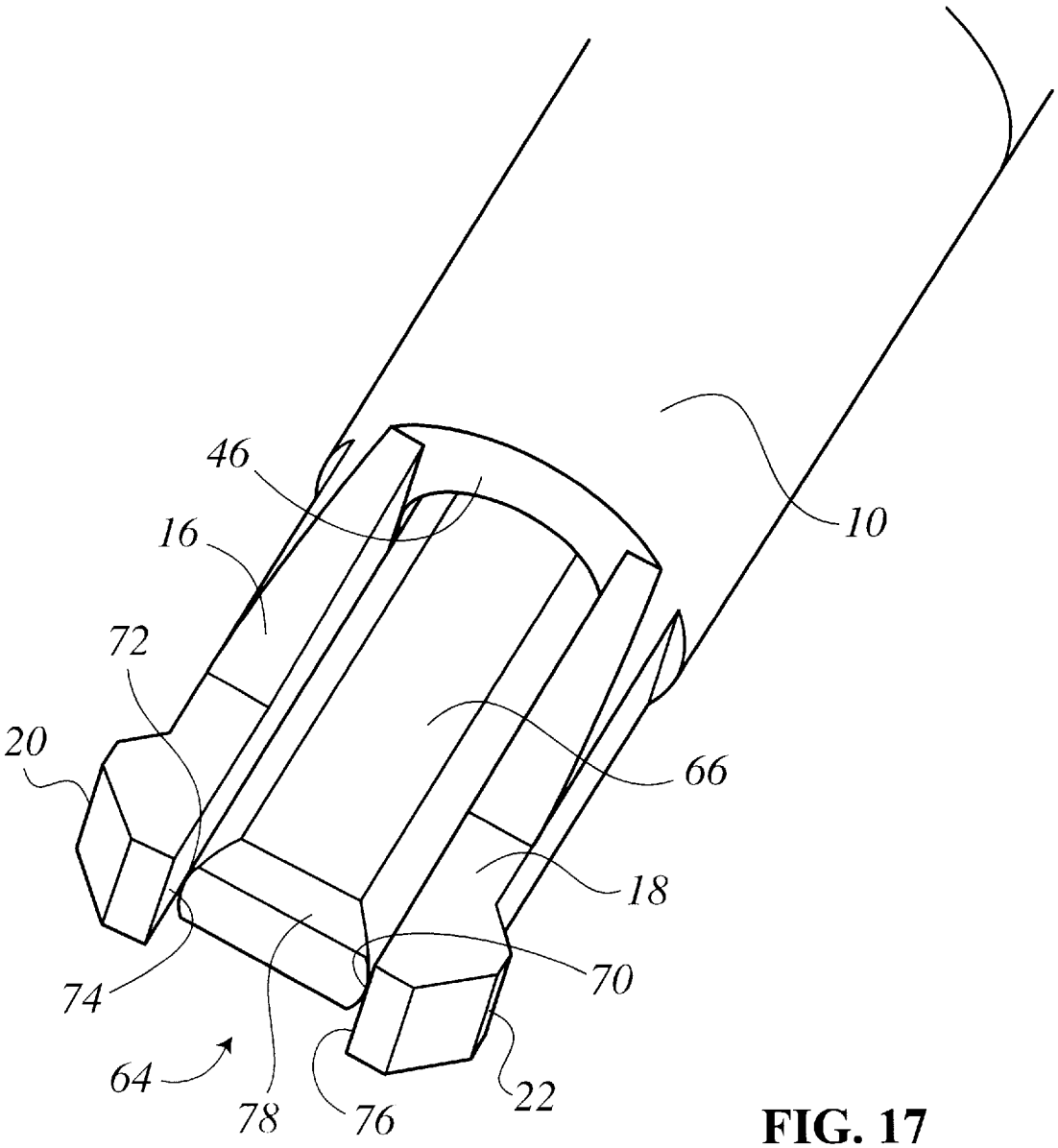
FIG. 17 is a partial isometric view of the end portion of a control shaft in accordance with the teachings of the instant invention.

A further alternate embodiment of the locking rod 24 is illustrated in isometric view in FIG. 14. As may be seen from this view, the profiled surfaces 66, 68, to accommodate the standard rectangular slot for the control knob, are extended along the entire axially length of locking rod 24 to the positioning shoulders 50, 56. While the accommodation of the rectangular slot on the control knob does not necessitate the surfaces 66, 68 to extend the length of locking rod 24 back to positioning shoulders 50, 56, this configuration may well be simpler to manufacture, and more cost effective due to the requirement for less material to be used. FIGS. 15 and 16 illustrate side views of this embodiment of locking rod 24 with FIG. 16 being rotated 90° about the long axis of locking rod 24. FIG. 17 illustrates this embodiment of locking rod 24 in partial isometric view as inserted in control shaft body 10. Once again, it may be seen that the inner surface 74, 76 of cantilever 16, 18 need not include any inwardly projecting protrusions as the outer diameter contact surfaces 70, 72 of locking rod 24 provides adequate interference to prevent the inward deflection of cantilevers 16, 18 in the locked position.

While alternate embodiments of locking rod 24 have been described, one skilled in the art will recognize that other configurations may be constructed from the above teachings and are, therefore, considered within the scope of the instant invention. However, it is important to note that a key distinguishing feature between the instant invention and prior systems which required that the securing of the locking rod within the control shaft body be accomplished at the forward end, the instant invention provides the locking mechanism at the rearward end 62 of the control shaft/locking rod assembly. A distinct advantage is realized by this configuration in that the outward deflection of the control shaft body 10 is no longer a concern. Therefore, a more secure locking mechanism utilizing a larger interference fit between the locking detents 58, 60 and the positioning shoulders 50, 52, 54, 56 and tabs 36, 38 (see FIGS. 8–9) may be utilized.

As may be recalled, the prior designs utilized a small rib on the inner surface of the cantilevers to provide the securing of the locking pin in place. However, the existence of the rib on the inner surface of the cantilevers resulted in an outward deflection of the cantilevers upon insertion of the locking pin. Since this outward deflection must be accommodated within the slot of the control knob, the total outer diameter of the cantilevers were required to be slightly less than they would have otherwise needed to be to accommodate the inner diameter of the control knob slot. The accommodation of this outward deflection of the cantilevers resulted in a less than solid fit of the control knob allowing for some movement or play when installed on the control shaft which could be considered by consumers to be a characteristic of a low quality part. To minimize the amount of play of the control knob on the end of the control shaft, the prior systems were required to utilize a very small rib on the inner surface of the cantilevers. However, since this small rib was the only mechanism holding the locking pin in place, this design is naturally prone to inadvertent displacement of the locking pin resulting in the control knob coming off the control shaft in the field. This, as described above, is a source of great frustration for consumers as they would then be required to either remove the front control panel of their appliance to reseat the locking pin, or incur the expense and waste of time of a service call, simply to replace the control knob.

As will be apparent to one skilled in the art, the instant invention overcomes these problems by providing the locking rod 24 securing mechanism at the rearward end 62 of the assembly. Since this rearward end 62 provides no consumer interface, the detents 58, 60 may be significantly larger than the locking ribs of the prior systems to provide a very secure lock of the locking rod 24. The resulting outward deflection of this rearward portion of the control shaft body 10 may be relatively quite large compared to that which could be tolerated on the forward end of the control shaft body 10 due to the necessity of providing a secure fit with the control knob. This is a significant advantage as it nearly eliminates any possibility of having the locking rod 24 inadvertently displaced while in the field. The instant invention therefore provides a much more secure feel to the securing of the control knob on the control shaft body 10 and virtually eliminates the problem of having the control knob come off the end of the control shaft due to an inadvertent unseating of the locking rod 24. This, in and of itself, is a significant advantage over the prior systems.

Further, if the control knob were to become detached from the end of the control shaft 10, the necessity of removing the front panel or making a service call is also removed due to the interaction of the tabs 36, 38 with the back cover 34 of the appliance controller. Whereas before, the consumer or repair person was required to remove the front panel of the appliance to gain access to the rear of the controller to resecure the locking pin in place, the instant invention allows the locking pin to be locked in place by simply placing the control knob on the end of the control shaft 10 and pushing the control shaft 10 to its retracted position. The detents 58, 60 on the rearward end 62 are forced back to engage the tabs 36, 38 to once again lock the control shaft in place. This not only provides a significant convenience, but greatly reduces the overall cost of ownership of appliances which utilize the instant invention.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure and implementation of the various components described above can be varied substantially without departing from the spirit of the invention, and the exclusive use of all modifications that come within the scope of the appended claims is reserved.

What is claimed is:

1. A control shaft for coupling user program selection information from a control knob to a program controller, the control knob having an engagement slot within its inner periphery, the control shaft comprising:

a control shaft body defining therein a central bore, said control shaft body including at a forward end thereof at least two cantilevers, said cantilevers having outwardly facing detents adapted to engage the engagement slot of the control knob, said control shaft body further including at a rearward end at least one slot communicating with said central bore and including positioning detents; and a locking rod positioned within said bore of said control shaft body, said locking rod having a forward end adapted to prevent inward deflection of said cantilevers of said control shaft body when said locking rod is in a locked position, said forward end of said locking rod further adapted to preclude outward deflection of said cantilevers during insertion thereof, said locking rod being secured in said locked position by said positioning detents.

2. The control shaft of claim 1, wherein said locking rod further comprises positioning shoulders adapted to engage said slot of said control shaft body, said positioning shoulders further cooperating with said positioning detents to maintain said locking rod within said central bore at a position allowing inward deflection of said cantilevers.

3. The control shaft of claim 2, wherein said positioning shoulders include a forward surface profiled to cooperate with said positioning detents to ease insertion of said locking rod into said central bore, and a rearward surface profiled to interfere with said positioning detents to obstruct removal of said locking rod from said central bore.

4. The control shaft of claim 2, wherein said locking rod further comprises at least one rearward end tab to engage said slot of said control shaft body, said rearward end tab further cooperating with said positioning detents to maintain said locking rod within said central bore at said locked position.

5. The control shaft of claim 4, wherein said rearward end tab includes a forward surface profiled to cooperate with said positioning detents to ease insertion of said locking rod into said central bore, and a rearward surface profiled to interfere with said positioning detents to obstruct removal of said locking rod from said central bore.

6. The control shaft of claim 5, wherein said control shaft body further defines a second slot opposite said at least one slot forming a pair of rearward cantilevers, and wherein said positioning detents are formed on edges of said rearward cantilevers at said slots such that said rearward cantilevers are outwardly deflected only by said positioning shoulders and said rearward end tabs.

7. A program controller having at least one cycle program operably stored therein, the selection of the cycle program performed by user rotation of a control knob, the control knob including an engagement slot within its inner periphery, the program controller comprising:

a housing;

a control shaft body defining therein a central bore, said control shaft body including a forward end thereof extending through a front of said housing, said forward end defining at least two cantilevers, said cantilevers having outwardly facing detents adapted to engage the engagement slot of the control knob, said control shaft body further including at a rearward end positioning detents; and a locking rod positioned within said bore of said control shaft body, said locking rod having a forward end adapted to prevent inward deflection of said cantilevers of said control shaft body when said locking rod is in a locked position, said forward end of said locking rod further adapted to preclude outward deflection of said cantilevers during insertion thereof, said locking rod being secured in said locked position by said positioning detents.

8. The controller of claim 7, wherein said locking rod further includes a rearward end defining an end tab, and wherein said locking rod is secured in said locked position by engagement of said end tab by said positioning detents.

9. The controller of claim 8, wherein said end tab includes a forward surface profiled to cooperate with said positioning detents to ease insertion of said locking rod into said central bore, and a rearward surface profiled to interfere with said positioning detents to obstruct removal of said locking rod from said central bore.

10. The controller of claim 8, wherein said housing includes a rearward cover, wherein said control shaft body may be linearly translated within said housing in a forward and a rearward direction, and wherein said rearward cover cooperates with said end tab as during rearward translation of said control shaft body to position said locking rod in said locked position.

11. The controller of claim 10, wherein said rearward cover defines an aperture therein positioned to allow access to said locking rod, and wherein said end tab radially extends beyond said aperture to engage said rearward cover.

12. The controller of claim 10, wherein said rearward cover captures said locking rod within said housing.

13. The controller of claim 7, wherein said control shaft body further defines at a rearward end thereof at least on slot communicating with said central bore, and wherein said locking rod further comprises positioning shoulders adapted to engage said slot of said control shaft body, said positioning shoulders further cooperating with said positioning detents to maintain said locking rod within said central bore at a position allowing inward deflection of said cantilevers.

14. The controller of claim 13, wherein said positioning shoulders include a forward surface profiled to cooperate with said positioning detents to ease insertion of said locking rod into said central bore, and a rearward surface profiled to interfere with said positioning detents to obstruct removal of said locking rod from said central bore.

15. The controller of claim 14, wherein said control shaft body further defines a second slot opposite said at least one slot forming a pair of rearward cantilevers, and wherein said positioning detents are formed on edges of said rearward cantilevers at said slots such that said rearward cantilevers are outwardly deflected only by said positioning shoulders and said rearward end tabs.

16. A method of securely attaching a control knob on a control shaft of a program controller, the control knob including an internal slot to affirmatively engage detents on the end of cantilevers on the forward end of the control shaft, the control shaft including an internal locking rod which in a locked position prevents the inward deflection of the cantilevers, comprising the steps of:

inserting the control knob on a forward end of the control shaft to allow the internal slot to engage the detents on the end of the cantilevers on the forward end of the control shaft; and pushing the control knob to linearly translate the control shaft to a retracted position whereby the locking rod is positioned between the cantilevers thereby preventing inward deflection of the cantilevers to preclude removal of the control knob.

17. The method of claim 16, further comprising, before the step of inserting the control knob on a forward end of the control shaft, the steps of:

pulling the control shaft to an extended position; and pushing the locking rod rearward to allow inward deflection of the cantilevers.

18. A locking rod for use with a control shaft including a central bore at least two cantilevers at its forward end, the cantilevers having outwardly facing detents adapted to engage an engagement slot of a control knob, the control shaft further including at a rearward end positioning detents, the locking rod comprising a body adapted to be inserted within the central bore of the control shaft, said body having a forward end adapted to prevent inward deflection of the cantilevers of the control shaft when said locking rod is in a locked position, said forward end of said body further adapted to preclude outward deflection of the cantilevers during insertion thereof between the cantilevers.

19. The locking rod of claim 18, wherein the control shaft includes a slot at a reward end thereof, and wherein said locking rod further comprises positioning shoulders adapted to engage the slot of the control shaft body, said positioning shoulders further adapted to cooperate with the positioning detents to maintain said locking rod within the central bore at a position allowing inward deflection of the cantilevers.

20. The locking rod of claim 19, wherein said positioning shoulders include a forward surface profiled to cooperate with the positioning detents to ease insertion of said locking rod into the central bore, and a rearward surface profiled to interfere with the positioning detents to obstruct removal of said locking rod from the central bore.

21. The locking rod of claim 20, wherein said locking rod further comprises at least one rearward end tab adapted to engage the slot of the control shaft, said rearward end tab further adapted to cooperate with the positioning detents to maintain said locking rod within the central bore at the locked position.

22. The locking rod of claim 21, wherein said rearward end tab includes a forward surface profiled to cooperate with the positioning detents to ease insertion of said locking rod into the central bore, and a rearward surface profiled to interfere with the positioning detents to obstruct removal of said locking rod from the central bore.

23. The locking rod of claim 18, wherein said forward end of said body are profiled to accommodate insertion of the control knob.

24. The locking rod of claim 23, wherein said profiling extends rearward along a length of said body.

* * * * *